US009541087B2

(12) United States Patent
Thibodeaux

(10) Patent No.: US 9,541,087 B2
(45) Date of Patent: Jan. 10, 2017

(54) SEALING GROMMET FOR CONNECTION BETWEEN TERMINAL HOUSING AND INTERIOR OF SEALED COMPRESSOR

(75) Inventor: Lamar Wilson Thibodeaux, Arkadelphia, AR (US)

(73) Assignee: Danfoss Scroll Technologies LLC, Arkadelphia, AR (US)

( * ) Notice: Subject to any disclaimer, the term of this patent is extended or adjusted under 35 U.S.C. 154(b) by 1133 days.

(21) Appl. No.: 13/178,555

(22) Filed: Jul. 8, 2011

(65) Prior Publication Data

US 2013/0011278 A1 Jan. 10, 2013

(51) Int. Cl.

| | |
|---|---|
| ***F04C 23/00*** | (2006.01) |
| ***F01C 19/00*** | (2006.01) |
| ***F04B 35/04*** | (2006.01) |
| ***F04B 39/12*** | (2006.01) |
| ***F04B 39/14*** | (2006.01) |
| ***H01R 13/52*** | (2006.01) |
| ***F04C 27/00*** | (2006.01) |

(52) U.S. Cl.

CPC ..... *F04C 23/008* (2013.01); *F01C 19/005* (2013.01); *F04B 35/04* (2013.01); *F04B 39/121* (2013.01); *F04B 39/14* (2013.01); *F04C 27/008* (2013.01); *H01R 13/5202* (2013.01); *F04C 2240/30* (2013.01); *F04C 2240/803* (2013.01)

(58) Field of Classification Search

CPC ..... F01C 19/005; F04B 35/04; F04B 39/121; F04B 39/14; F04C 23/008; F04C 27/008; F04C 2240/30; F04C 2240/803; H01R 13/5202

USPC ..... 417/410.1, 902; 439/271, 587–589; 277/628, 630, 637; 310/71

See application file for complete search history.

(56) References Cited

U.S. PATENT DOCUMENTS

| | | | | |
|---|---|---|---|---|
| 3,495,028 | A * | 2/1970 | Tutthill | 174/153 R |
| 4,840,547 | A * | 6/1989 | Fry | 417/422 |
| 4,966,559 | A * | 10/1990 | Wisner | 439/566 |
| 5,199,898 | A * | 4/1993 | Wisner | 439/367 |
| 5,385,453 | A * | 1/1995 | Fogt et al. | 417/410.5 |
| 7,059,839 | B2 * | 6/2006 | Haller | F01C 21/10 184/6.16 |
| 7,763,808 | B2 * | 7/2010 | Tolbert, Jr. | 174/152 R |
| 2008/0138226 | A1 * | 6/2008 | Koitabashi et al. | 418/55.1 |

* cited by examiner

*Primary Examiner* — Devon Kramer
*Assistant Examiner* — Joseph Herrmann
(74) *Attorney, Agent, or Firm* — Carlson, Gaskey & Olds, PC

(57) ABSTRACT

A sealed compressor has an electric motor received within a hermetically sealed shell. The electric motor drives a compressor pump unit. An electric connection provides electric power to the motor. A terminal housing is mounted on the shell, with a terminal plug for supplying electrical power from outside of the shell into a connector within the shell. A grommet is at an opening in the shell which allows passage of the electric connector from the terminal plug to the electric connection. The grommet has a first surface positioned on an opposed side of a wall of a housing spaced from the shell, and a second surface sealing against the shell. The grommet has an interior portion allowing passage of the electrical connections from the terminal plug into the electric connector within the shell.

5 Claims, 4 Drawing Sheets

SEALING GROMMET FOR CONNECTION BETWEEN TERMINAL HOUSING AND INTERIOR OF SEALED COMPRESSOR

BACKGROUND

This application relates to a sealing grommet for sealing between the walls of a terminal housing, and a sealed compressor shell.

Compressors are known and typically include a motor driving a compressor pump unit within a sealed shell. The shell is typically sealed, as refrigerant circulates within the shell to cool the motor. Even though the shell is sealed, an electric connection must still extend into the shell to supply power to the motor.

The connection through the shell must be adequately sealed, and the arrangement of a terminal housing and compressor shell has made this a challenge.

SUMMARY

A sealed compressor has an electric motor received within a hermetically sealed shell. The electric motor drives a compressor pump unit. An electric connection provides electric power to the motor. A terminal housing is mounted on the shell, with a terminal plug for supplying electrical power from outside of the shell into a connector within the shell. A grommet is at an opening in the shell which allows passage of the electric connection from the terminal plug to the electric connector. The grommet has a first surface positioned on an opposed side of a wall of a housing spaced from the shell, and a second surface sealing against the shell. The grommet has an interior portion allowing passage of the electrical connections from the terminal plug into the electric connector within the shell.

These and other features of the present invention can be best understood from the following specification and drawings, of which the following is a brief description.

DETAILED DESCRIPTION

Figure 1:
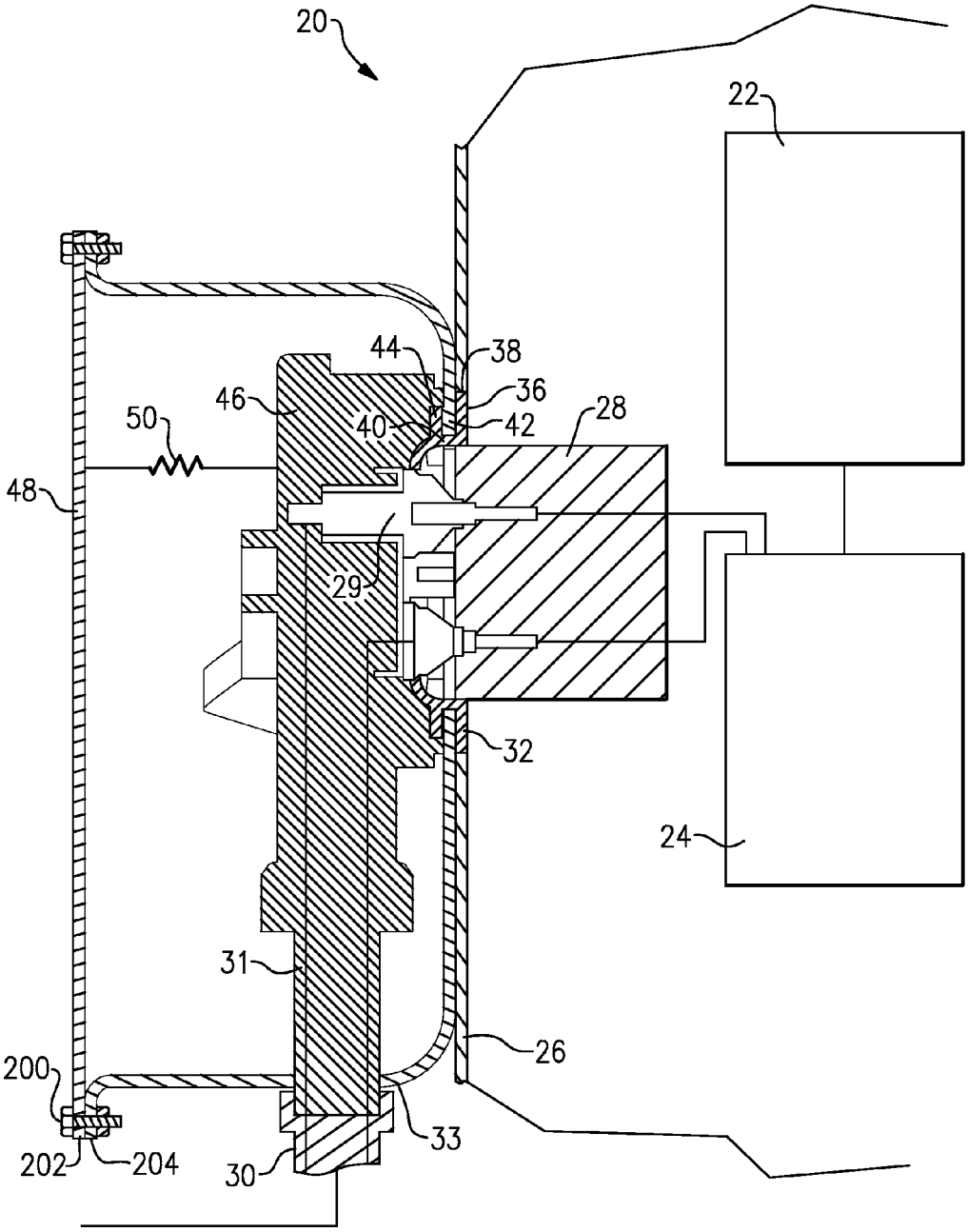
FIG. 1 shows an electric terminal connection through a sealed compressor shell.

FIG. 1 shows a sealed compressor 20 incorporating a compressor pump unit 22 and an electric motor 24. A shell 26 defines an interior which is sealed against fluid leakage. Refrigerant typically flows around the motor 24 within the shell 26. Electric power must be supplied to the motor 24, and an electric connector 28 is shown inward of the shell 26. A terminal connection 29 is shown extending from a terminal plug 31 which is connected within a fence or housing 42.

A cable 30 plugs into an end of the terminal connection 31 outwardly of the housing 42. A hole 33 allows the terminal plug 31 to exit the housing. A cover 46 is shown bolted at 200 to the housing at an ear 204 and hole 202 in cover 46.

A grommet 32 provides a fluid tight seal between the housing 42 and the shell 26. As shown, the grommet 32 has ears 44 sitting outwardly of an end of the housing 42, and an end 36 which seals against the shell 26.

As shown in this Figure, a spring 50 is schematically biasing the terminal plug 46 to maintain the connection between connector 28 and pin 29.

Figure 2:
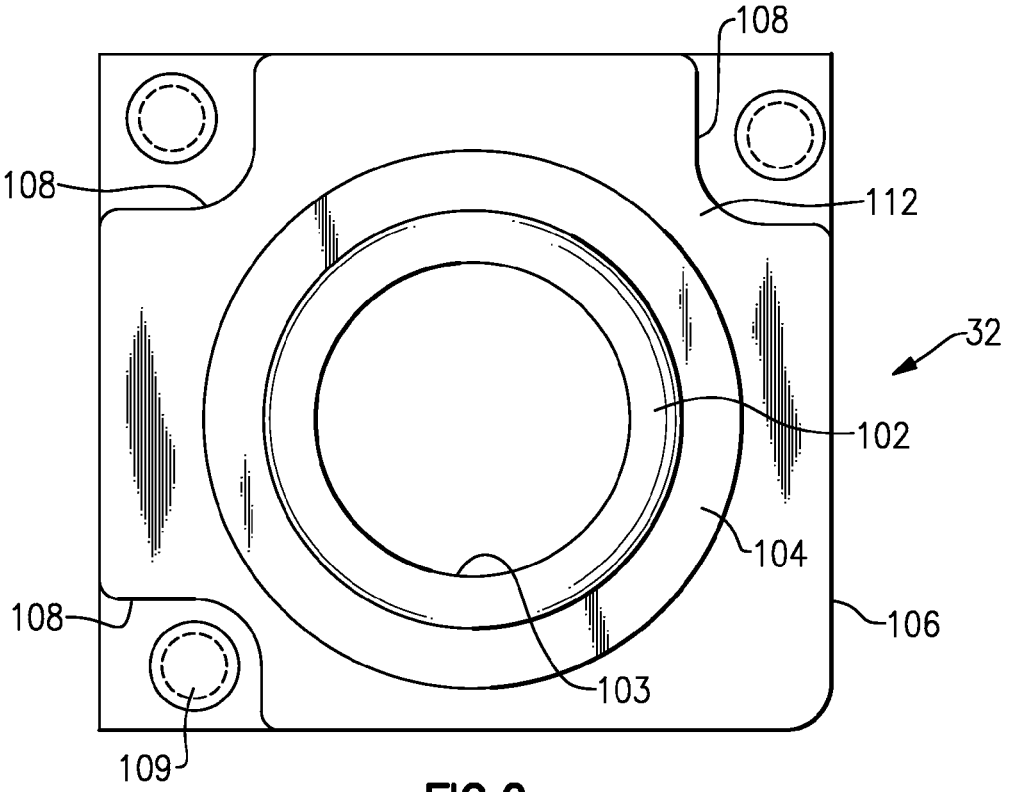
FIG. 2 is a top view of a first embodiment grommet.

Grommet 32 is shown in a top view in FIG. 2. As shown, a bore 103 is hollow, and allows electrical connections to pass through. An upper circular portion 102 sits against the terminal plug (see FIG. 1) to provide a seal against the plug. An outer portion 104 sits outwardly of the terminal plug 42 to provide a seal.

Figure 3:
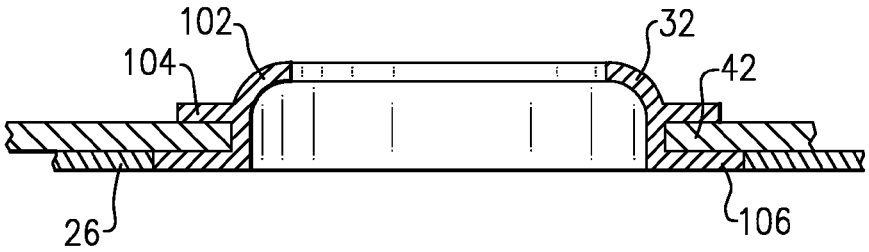
FIG. 3 is a cross-sectional view through the FIG. 2 grommet.

A lower portion 106 sits within a bore through the compressor shell 26. As shown in FIGS. 2 and 3, the portion 106 extends further than does the portion 104. The portion 104 sits inwardly of the housing 42, and the portion 106 sits flush with the compressor shell 26.

Cutout portions 108 surround holes 109 for the bolts which will connect the terminal housing to the shell.

Figure 4:
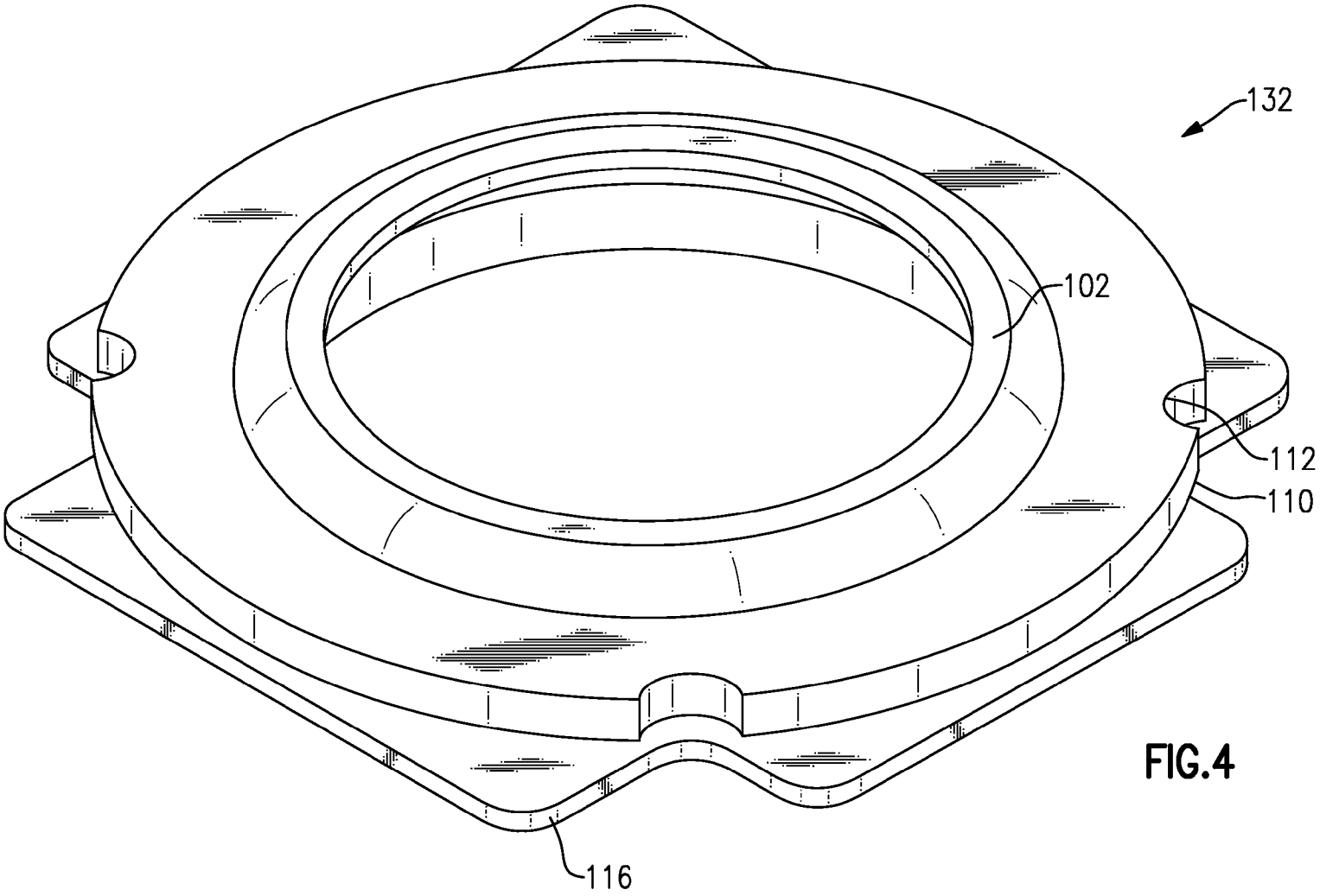
FIG. 4 shows a second embodiment grommet.

As shown in FIG. 4, an embodiment 132 of the grommet has a hollow interior bore, portion 116 which sits within the compressor shell, portion 110 which sits inwardly of the terminal box, and portion 102 which sits upwardly into the terminal plug. Notches 112 allow the passage of bolts.

Figure 5:
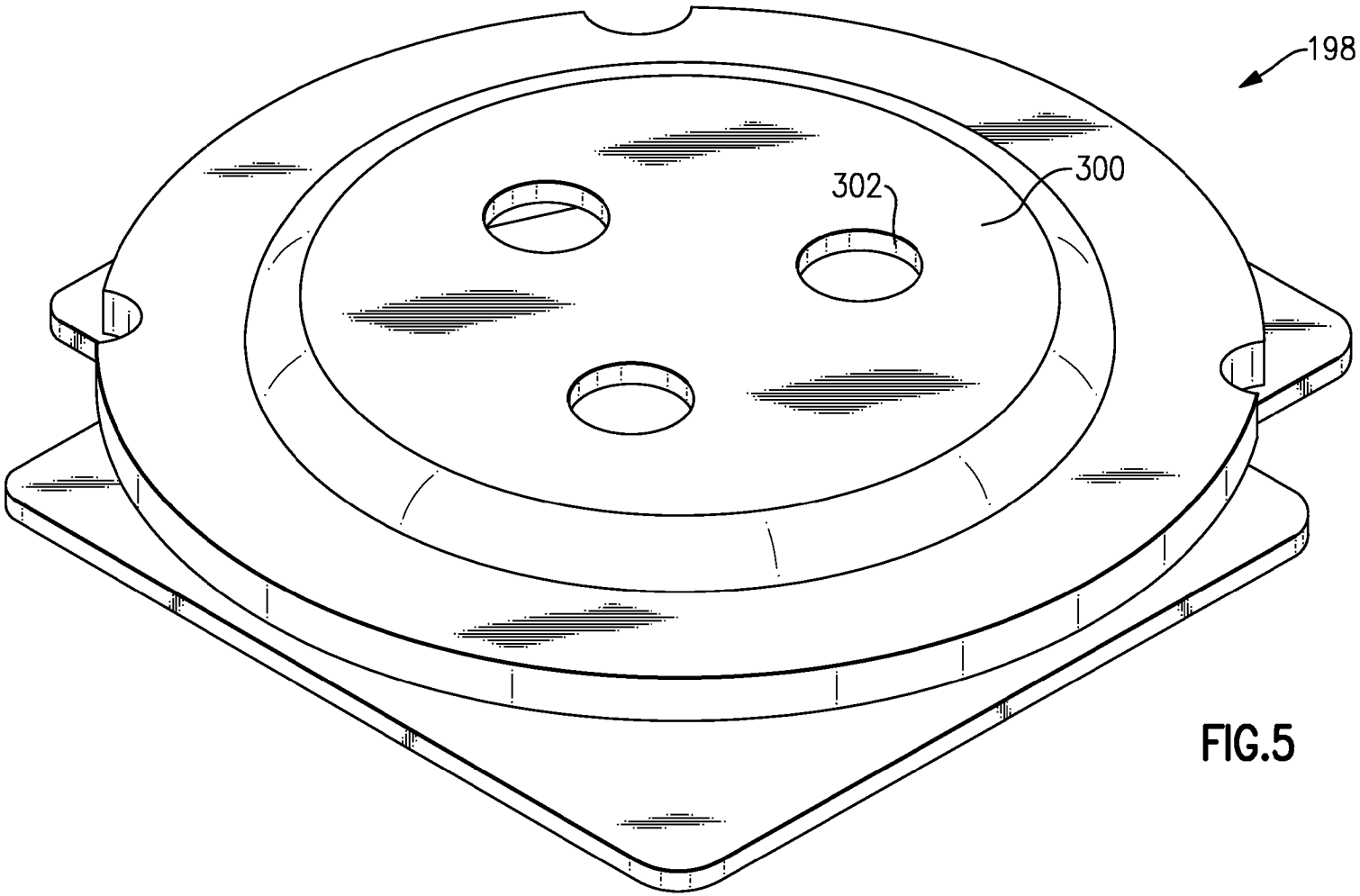
FIG. 5 shows a third embodiment grommet.

FIG. 5 shows an embodiment 198, wherein the bore is sealed by a portion 200, but pin holes 202 are formed through the grommet for passage of the connecting pin.

The spring 50 is shown schematically, however, details of the spring are better disclosed in co-pending U.S. patent application Ser. No. 13/178,616, filed on even date herewith, and entitled "Secure Connection Terminal for Hermetic Compressor." The cable is better disclosed in co-pending U.S. application Ser. No. 13/178,568, filed on even date herewith, and entitled "Terminal Connection for Sealed Compressor," now U.S. Pat. No. 8,328,566, issued Dec. 11, 2012.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

an electric motor received within a hermetically sealed shell, and said electric motor driving a compressor pump unit, an electric connection through said shell for providing electric power to said motor, a terminal housing mounted outwardly on said shell, with a terminal plug for supplying electrical power from outside of said shell into an electric connector within said shell, and a grommet at an opening in said shell which allows passage of the electric connection from said terminal plug to said electric connector, said grommet having a curved portion sealing against a face of said terminal plug facing said shell, and an outer surface sealing against an outer surface of said terminal housing facing said shell, with said grommet having an interior portion allowing passage of the electrical connections from said terminal plug into said electric connector within said shell.

2. The compressor as set forth in claim 1, wherein said grommet has a surface which sits flush within said opening in said compressor shell.

3. The compressor as set forth in claim 1, wherein said grommet has a central hollow passage to allow passage of the electrical connections.

4. The compressor as set forth in claim 1, wherein said grommet has a generally solid central portion, with pin holes allowing passage of electric pins to provide said electric connections.

5. The compressor as set forth in claim 2, wherein said grommet has a central hollow passage allow passage of the electrical connections.

* * * * *